US010696002B2

(12) United States Patent
Mulvey et al.

(10) Patent No.: US 10,696,002 B2
(45) **Date of Patent: *Jun. 30, 2020**

(54) PAPER CRUMPLER AND METHOD

(71) Applicant: Danco Packaging Supply Company, Elk Grove Village, IL (US)

(72) Inventors: Daniel Edward Mulvey, Elk Grove Village, IL (US); Daniel Joseph Mulvey, Elk Grove Village, IL (US)

(73) Assignee: Danco Packaging Supply Company, Elk Grove Village, IL (US)

( * ) Notice: Subject to any disclaimer, the term of this patent is extended or adjusted under 35 U.S.C. 154(b) by 207 days.

This patent is subject to a terminal disclaimer.

(21) Appl. No.: 15/641,094

(22) Filed: Jul. 3, 2017

(65) Prior Publication Data

US 2017/0297289 A1 Oct. 19, 2017

Related U.S. Application Data

(63) Continuation of application No. 13/736,261, filed on Jan. 8, 2013, now Pat. No. 9,694,554.

(51) Int. Cl.
*B31D 5/00* (2017.01)

(52) U.S. Cl.
CPC ..... *B31D 5/0043* (2013.01)

(58) Field of Classification Search
CPC ..... B65D 83/0805; B65D 85/04; B65D 5/12; B65D 85/675; A61F 15/001; B65H 55/043; B65H 2701/1846; A47K 10/3818; A47K 2010/3206; Y10T 225/248; B31D 5/0043

See application file for complete search history.

(56) References Cited

U.S. PATENT DOCUMENTS

| | | | |
|---|---|---|---|
| 1,707,619 | A | 4/1929 | King |
| 1,901,532 | A | 3/1933 | Powell |
| 2,004,614 | A | 6/1935 | Meagher |
| 2,015,653 | A | 10/1935 | Andrews |
| 2,017,176 | A | 10/1935 | Andrews |
| 2,020,663 | A | 11/1935 | Stapleford |
| 2,293,187 | A | 8/1942 | Becker |
| 2,864,495 | A | 12/1958 | Ritchie |
| 3,349,959 | A | 10/1967 | Watkins |
| 3,749,296 | A | 7/1973 | Harrison |
| 3,868,052 | A | 2/1975 | Rockefeller |
| 4,328,907 | A | 5/1982 | Beard |
| 4,958,733 | A | 9/1990 | Masuda |
| 5,131,903 | A | 7/1992 | Levine et al. |
| 5,346,064 | A | 9/1994 | Rizzuto |

(Continued)

*Primary Examiner* — William A. Rivera
(74) *Attorney, Agent, or Firm* — Lempia Summerfield Katz LLC

(57) ABSTRACT

A paper crumpler has a dispenser with a bottom, a top, a side wall between the bottom and the top, and a cavity defined by the bottom, the top, and the side wall. A hole is formed in the top of the dispenser. A shelf is positioned within the cavity below the top of the dispenser. Uncrumpled paper is stored in the cavity beneath the shelf. An orifice is formed in the shelf. The orifice has protrusions that extend radially inward toward one another and that are configured to contact the uncrumpled paper when the uncrumpled paper is passed through the orifice from the cavity to thereby form crumpled paper above the shelf. The crumpled paper can be dispensed from the dispenser through the hole.

20 Claims, 3 Drawing Sheets

(56) References Cited

U.S. PATENT DOCUMENTS

| | | | | |
|---|---|---|---|---|
| 5,704,471 | A | 1/1998 | Yamada | |
| 7,204,450 | B1 | 4/2007 | Mallory | |
| 7,530,460 | B2 | 5/2009 | Lewis et al. | |
| 7,578,414 | B2 | 8/2009 | Sellars et al. | |
| 8,202,209 | B2 | 6/2012 | Cheich | |
| 9,694,554 | B2 * | 7/2017 | Mulvey | B31D 5/0043 |
| 2014/0174974 | A1 | 6/2014 | Bechyne | |
| 2014/0175110 | A1 | 6/2014 | Bechyne | |

* cited by examiner

PAPER CRUMPLER AND METHOD

RELATED APPLICATION DATA

This patent is related to and claims priority benefit of U.S. patent application Ser. No. 13/736,261 filed Jan. 8, 2013, entitled "Apparatus, System, and Method for Crumpling Paper", and which is set to issue as U.S. Pat. No. 9,694,554. The entire contents of this prior filed application are hereby incorporated herein by reference.

BACKGROUND

1. Field of the Disclosure

The present invention generally relates to an apparatus, a system and a method for crumpling paper. More specifically, the present invention relates to a container holding paper that dispenses through the container. The paper is crumpled while being dispensed from the container.

2. Description of Related Art

Crumpled paper is often desirable to be used as a material to cushion and/or protect an item or items during shipment. An item often shifts within a box or other package in which the item is placed and thus may incur damage. Crumpled paper may be inserted around the item placed in the box and/or the package to surround the item. If the item shifts during shipment, the item may be protected by the crumpled paper prior to contacting another surface, such as a side wall of the box in which the item is shipped, for example. Thus, the crumpled paper may cushion the item during shipment to protect the item from damage.

Without crumpled paper, the item may contact a side wall of the box in which the item is shipped and may be subjected to damage during shipment. Using crumpled paper as a cushioning material may prevent this undesirable result.

Dispensing of crumpled paper, however, is often difficult and/or time consuming and/or requires a great deal of space. Known systems and/or methods for dispensing crumpled paper may not adequately meet the needs of a small-scale user and/or a home-based user. Known crumpled paper dispensation systems may be tailored to suit the needs of industrial operations and thus offer large volumes of crumpled paper, for example. To that end, such systems may involve sophisticated machinery with many moving parts. Further, such systems may be immovable due to size. Other known systems may use decorative and/or ornamental paper dispensation, or the dispensation of crumpled paper strings and/or strips, for example. Such applications may fail to meet the needs of the small-scale user and/or the home-based user who intends to primarily use crumpled paper as a material to cushion items during shipment.

As an example, U.S. Pat. No. 5,131,902 to Levine et al. discloses a mechanism for producing crumpled paper and/or dunnage in strips. Other crumpled paper and/or dunnage making mechanisms and methods are disclosed in U.S. Pat. No. 8,202,209 to Cheich and U.S. Pat. No. 4,958,733 to Masuda. Levine et al. disclose an apparatus for crumpling and dispensing dunnage from a roll of stock paper material. The apparatus has a frame with a pair of side walls for guiding sheet paper from the roll of paper in a converging manner. The apparatus also has a box-like housing with an opening in alignment with a reduced dimension corrugated-shaped opening.

Known methods, apparatuses or systems for crumpling paper may use various moving parts including rollers for pulling paper and crushing and/or compacting the same. Such machinery may be large, expensive and/or immovable. Thus, a need exists for a dispenser that may crumple paper for use in an establishment and/or at home, for example.

SUMMARY

The present invention generally relates to an apparatus, a system and a method for crumpling paper. More specifically, the invention relates to a container with a paper crumpler. A paper roll is placed in the container. The paper passes through the paper crumpler as the paper is dispensed from the container. Crumpled paper may then be drawn from the container.

More particularly, the invention provides a method for crumpling paper. The method may include storing a paper roll within a box. The paper may be wound around an airshaft that forms a core of the paper roll and may be dispensed from the core of the paper roll. Further, the paper may be removed from the box wherein the paper may be crumpled within the box during removal.

The invention also provides an apparatus for crumpling paper. The apparatus may have a box with a base, a top and walls that define an interior. A shelf in the interior of the box separates the interior of the box into a first section and a second section. A crumpler may be formed in the shelf. A hole is provided at the top of the box. The crumpler and the hole are vertically aligned with respect to the walls of the box.

Additionally, the invention provides a system having a box with an interior, and a paper roll placed in the interior of the box. The paper roll may have a length of paper wound around an air core. A shelf is provided in the interior of the box wherein the shelf separates the interior into a first section and a second section. The paper roll may be placed in the first section. An orifice is provided in the shelf. Paper is initiated from the air core and fed through the orifice.

Accordingly, it is an advantage of the present invention to provide an apparatus, a system and a method for crumpling paper.

Another advantage of the present invention is to provide an apparatus, a system and a method for crumpling paper from a paper roll.

Yet another advantage of the present invention is to provide an apparatus, a system and a method for crumpling paper from a dispenser that may be discarded.

Still another advantage of the present invention is to provide an apparatus, a system and a method for crumpling paper that may be transported.

A further advantage of the present invention is to provide an apparatus, a system and a method for crumpling paper for small scale retail operations and/or home users.

A still further advantage of the present invention is to provide an apparatus, system and method for crumpling paper that maintains the paper in a crumpled state.

Additional features and advantages of the present invention are described in, and will be apparent from, the detailed description of the presently preferred embodiments and from the drawings.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

In the following description, numerous details are set forth to provide an understanding of the present invention. Further, numerous variations or modifications from the described embodiments may be possible.

Figure 1:
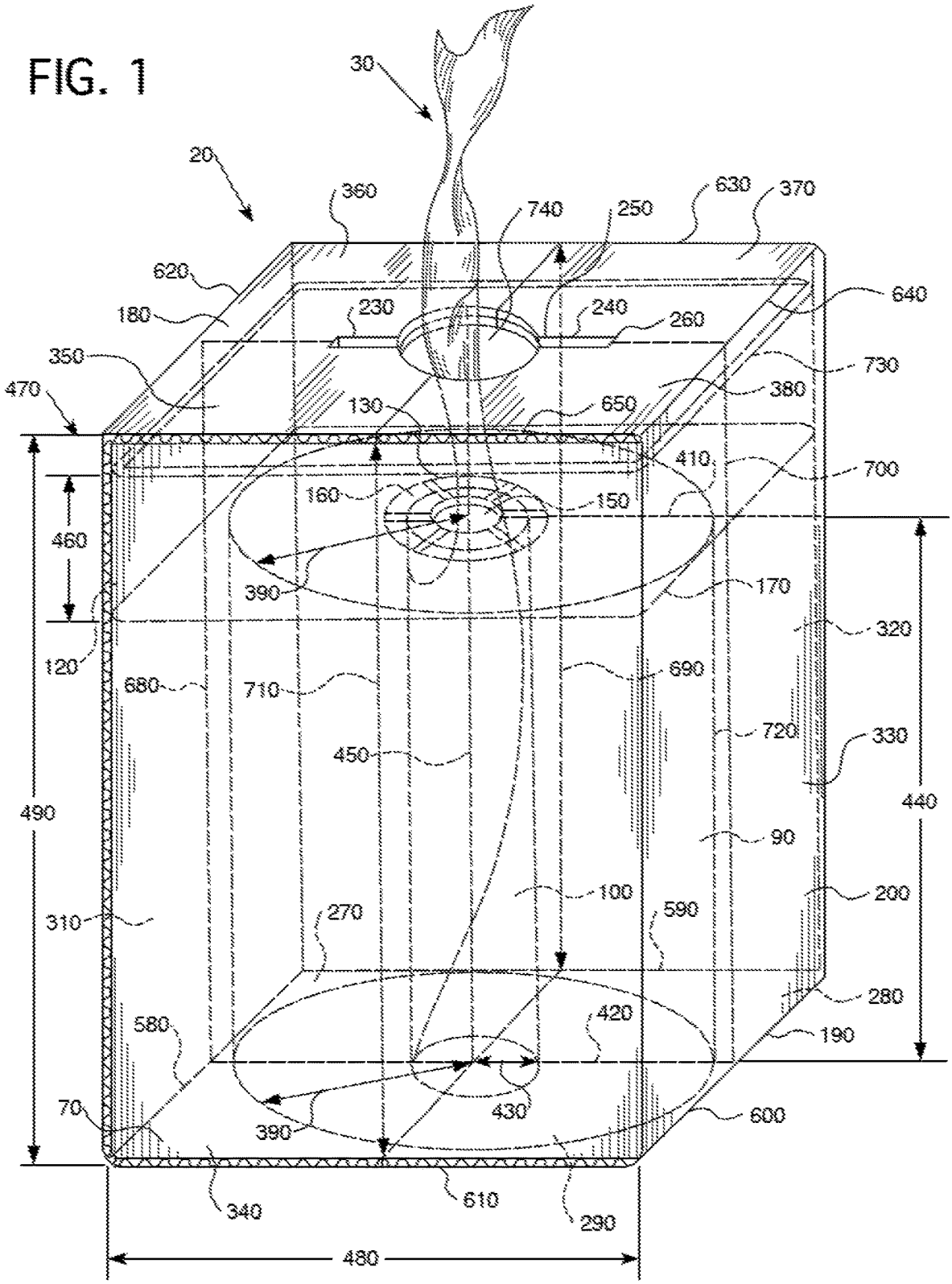
FIG. 1 illustrates a perspective view of an embodiment of the apparatus for crumpling paper of the present invention.

Referring to FIG. 1, a perspective view of a paper dispenser 20 is shown. In an embodiment, the dispenser 20 is formed as a box. The paper dispenser 20 may be constructed of a rigid material, such as cardboard, to prevent against collapse or be otherwise susceptible to damage. The paper dispenser 20, however, may be constructed of any material to implement the present invention. As shown, the dispenser 20 may have a defined base 190 having a width defined as the distance from a third side panel 330 to a first side panel 310, as shown in FIG. 1. Further, the base 190 may be formed by folding a lower flap of each side panel inward to the other lower flaps where each flap is at an angle perpendicular to the side panel to which the flap is adhered. More particularly, a first lower flap 70 may be folded inwardly along a first lower horizontal line 580. A third lower flap 280 may be folded inwardly along a third lower horizontal line 600 to contact the first lower flap 70. A second lower flap 270 may be folded inwardly along a second lower horizontal line 590. A fourth lower flap 290 may be folded inwardly along a fourth lower horizontal line 610 to contact the second lower flap 270. The second lower flap 270 and the fourth lower flap 29D may be folded to surround the first lower flap 70 and the third lower flap 280 to form the base 190. Alternatively, each lower flap may be folded in a different order to form the base 190.

A paper roll 90 may be wound around an airshaft 100 and placed on top of the base 190 when the box is constructed. The airshaft 100 may be produced by a manufacturing technique and/or process that involves wrapping and/or winding paper around an air core to form a paper roll, such as the paper roll 90, for example. However, unlike a traditional paper roll that may have a solid cylindrical core, the cylindrical core around which the paper 720 is wrapped may either be air or may be removed to form the paper roll 90 with a hollow core, i.e. the airshaft 100.

Also, in an embodiment, the paper roll 90 may be made from, for example, craft paper. Preferably, thirty-pound craft paper may be used. The paper roll 90 may have a length of at least fifteen hundred feet when unwound. The airshaft 100 forms a hollow and accessible core of the paper roll 90 from which the paper 720 may be dispensed. Further, the paper roll 90 may have a height defined as the distance from a bottom surface 420 of the paper roll 90 to a top surface 410 of the paper roll 90. Also, the paper roll 90 may have a radius 390 that extends from a point on the airshaft 100 to each of the side panel 310, 320, 330 and 340 along a center line on each of the side panels 310, 320, 330 and 340.

The center line may be located between a first edge of a given side panel and another edge of that side panel positioned opposite and parallel to the first edge of the side panel. Specifically, the paper roll 90 may be oriented as shown in FIG. 1 such that an exterior surface of the paper roll 90 may contact the first side panel 310 along a first center line 680, the second side panel 320 along a second center line 690, the third side panel 330 along a third center line 700 and the fourth side panel 340 along a fourth center line 710.

A shelf section 110 may be placed inside the dispenser 20 above the paper roll 90 such that a bottom surface of a base section 170 of the shelf section 120 may contact the paper roll 90 as illustrated in FIG. 1. This arrangement forms an inner cavity 200 within the dispenser 20 as defined as the region between the underside of the base section 170 and the top surface of the base 190. The sidewall 120 of the shelf section 110 may be placed along the inner surface of the side panels 310, 320, 330 and 340 to mount the shelf section 110 in the position described. The sidewall 120 may have a height 460 defined as the distance from the base section 170 of the shelf section 110 to a selected end point on the associated side panels 310, 320, 330 or 340.

Figure 6:
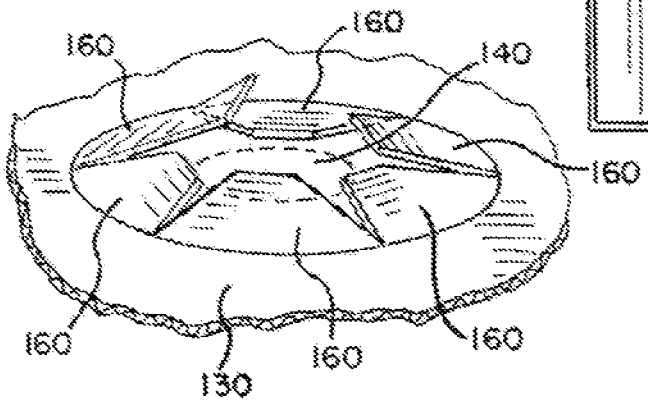
FIG. 6 illustrates a perspective view of an embodiment of a crumpler of the present invention.

A crumpler 130 may be located at a center of the base section 170 of the shelf section 120. The crumpler 130 may have protrusions 160 located around the perimeter of an orifice 150. The paper 720 may be pulled to initiate removal of the paper 720 from the airshaft 100 of the paper roll 90 through the orifice 150. The paper 720 may contact the protrusions 160 that may cause the protrusions 160 to crumple the paper 720. Movement of the paper 720 through the orifice 150 may enlarge the orifice 150 as needed to accommodate the paper 720 as shown in FIG. 6. The protrusions 160 may contact the paper 720 as the paper 720 is pulled through the orifice 150 in the crumpler 130 to crumple and/or crush the paper 720 to form crumpled paper 30.

The distance from an upper edge 730 of the sidewall 120 of the shelf section 110 to upper horizontal lines 620, 630, 640 and 650 may be defined as a height 470. In the embodiment shown in FIG. 1, to complete construction of the dispenser 20 as a box, upper flaps 350, 360, 370 and 380 may be folded at an angle perpendicular to each of the side panels 310, 320, 330 and 340. More specifically, the second upper flap 360 may be folded along the second upper horizontal line 630 against the fourth upper flap 380 that may be folded along the fourth horizontal line 650. Next, the first upper flap 350 having a first slit 230 may be folded against the third upper flap 370 having a second slit 240. Further, each of the upper flaps 350, 360, 370 and 380 may have a cutout BO that, when assembled as shown, forms a hole 740. The first slit 230 and the second slit 240 may extend lengthwise from the hole 740 and may lie along a line 180 that is parallel to the second upper horizontal line 630 and fourth upper horizontal line 650. The paper 720 may be pulled from the paper roll 90 through the orifice 150 in the crumpler 130 and through the protrusions 160 and further through the hole 740 to exit the dispenser 20 in a crumpled state. The crumpled paper 30 may now be grasped by a user. Further, the crumpled paper 30 may be severed to a desired size by contacting the crumpled paper 30 along an edge of the first slit 230 and/or the second slit 240.

Figure 2A:
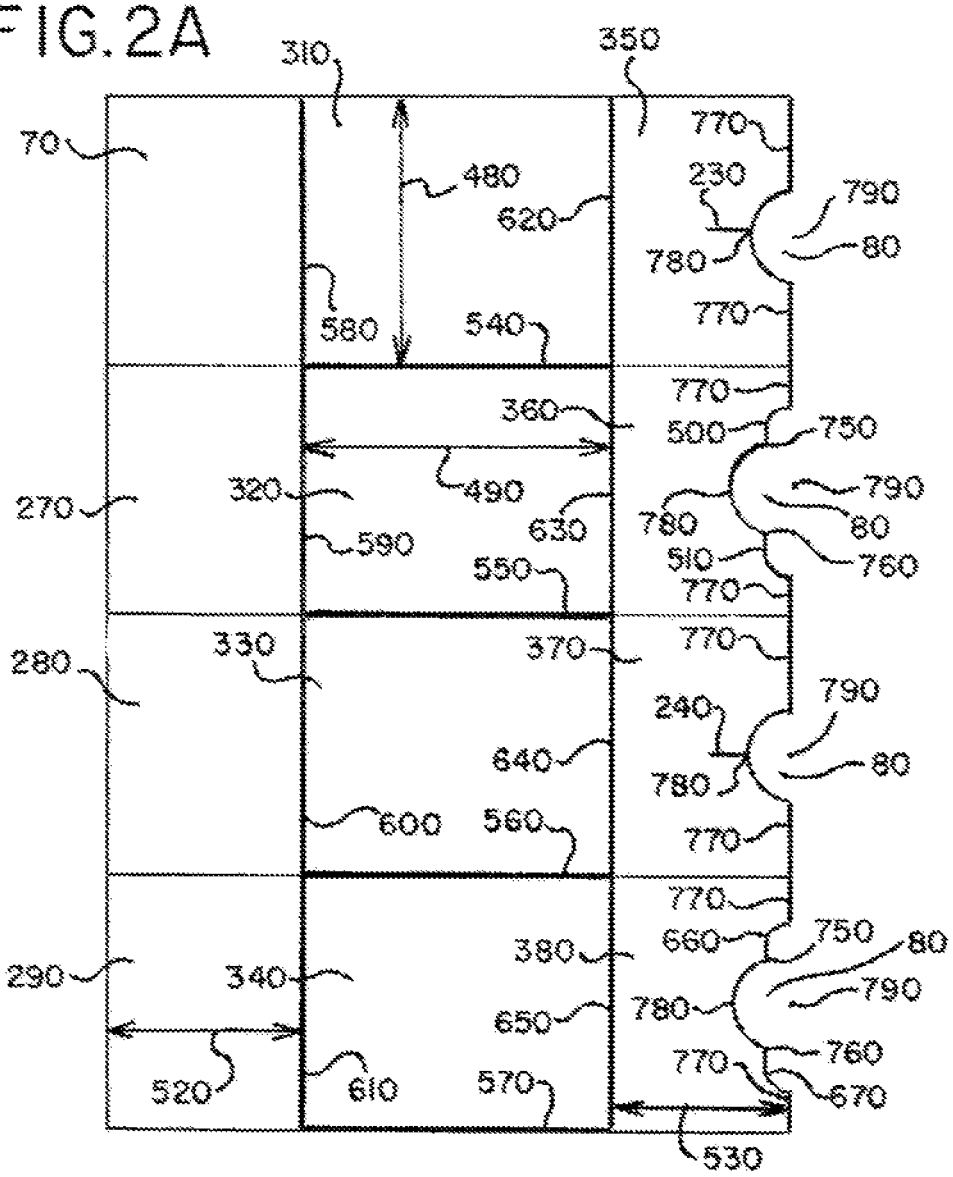
FIG. 2A illustrates a plan view of an embodiment of a box of the present invention.

Referring to FIG. 2A, the dispenser 10 is shown unfolded. The dispenser 10 has four side panels, namely the first side panel 310, the second side panel 320, the third side panel 330 and the fourth side panel 340. In the embodiment shown by FIG. 2A, the first side panel 310 joins the second side panel 320 lengthwise along a first shared vertical line 540. The second side panel 320 joins the third side panel 330 along a second shared vertical line 550. The third side panel 330 joins the fourth side panel 340 along a third shared vertical line 560. Finally, the fourth side panel 340 joins the first side panel 310 along a fourth shared vertical line 570 for construction of the dispenser as a box.

As shown in FIG. 2A, each of the side panels 310, 320, 330 and 340 may have a corresponding lower flap 70, 270, 280 and 290 and an upper flap 350, 360, 370 and 380. The lower flaps 70, 270, 280 and 290 and the upper flaps 350, 360, 370 and 380 may join their associated side panels 310, 320, 330 and 340 along a lower line and an upper line, respectively. Thus, the first lower flap 70 may join the first side panel 310 along the first lower horizontal line 580. Next, the second lower flap 270 may join the second side panel 320 along the second lower horizontal line 590. Similarly, the third lower flap 280 may join the third side panel 330 along the third lower horizontal line 600. Finally, the fourth lower flap 290 may join the fourth side panel 340 along a fourth lower horizontal line 610. Each of the lower flaps 70, 270, 280 and 290 may be folded along their respective lower horizontal lines at an angle perpendicular to the side panels 310, 320, 330 and 340. Each of the lower flaps 70, 270, 280 and 290 may be folded to form the base 190 when the dispenser 20 is constructed as a box. In an embodiment, the flaps 70, 280 may be folded inward toward each other with the flaps 270, 290 folded inward and around the flaps 70, 280 to form the base 190. In an alternative embodiment, the flaps 270, 290 may be folded inward toward each other with the flaps 70, 280 folded inward toward each other and around the flaps 270, 290 to form the base 190.

Figure 2B:
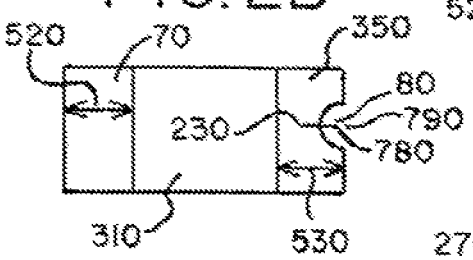
FIG. 2B illustrates a plan view of an embodiment of a box of the present invention.
Figure 2C:
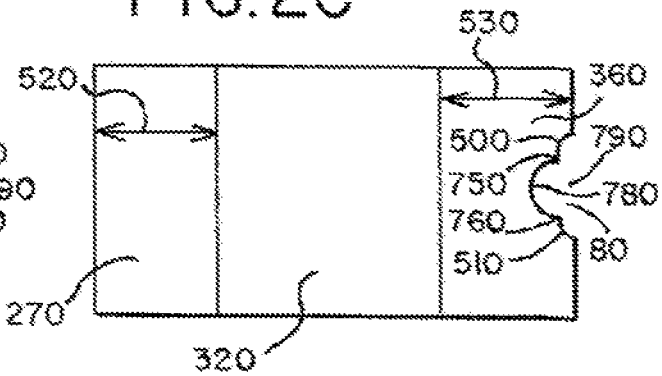
FIG. 2C illustrates a plan view of an embodiment of a box of the present invention.

Referring to FIG. 2A, and further shown in FIGS. 2B and 2C each of the side panels 310, 320, 330 and 340 may also connect to the upper flaps 350, 360, 370 and 380. The upper flaps 350 and 370 may have a cutout 80 with a slit extending lengthwise from an apex 780 of the cutout 80 as shown in FIGS. 2A and 2B. The upper flaps 360 and 380 may have a cutout 80 with first indentations 500 and 660 and second indentations 510 and 670, respectively, as shown in FIGS. 2A and 2C. The first indentations 500 and 660 may be located between a first end 750 of the cutout 80 and an edge 770 of the upper flaps 360 and 380, respectively. Similarly, the second indentations 510 and 670 may be located between a second end 760 of the cutout 80 and the edge of the upper flap 770, respectively.

More specifically, the first side panel 310 may attach to the first upper flap 350 along the first upper horizontal line 620. The first upper flap 350 may have the cutout BO located at a center 790 of the first upper flap 350 where the first slit 230 may extend lengthwise from the apex 780 of the cutout 80. Next, the second side panel 320 may join the second upper flap 360 along the second upper horizontal line 630. The second upper flap 360 may have a first indentation 500 extending inwardly from an outer surface of the second upper flap 360. Similarly, the second upper flap 360 may have a second indentation 510 positioned opposite to the first indentation 500. The cutout 80 may extend toward the second upper horizontal line 630 from the center 790 of any of the upper flaps 350, 360, 370 and 380. Further, the third side panel 330 may join the third upper flap 370 along the third upper horizontal line 640. The third upper flap 370 may have the cutout 80 located at the center 790 of the third upper flap 370 where the second slit 240 may extend lengthwise from the apex 780 of the cutout 80. Finally, the fourth side panel 340 may attach to the fourth upper flap 380 along the fourth upper horizontal line 650. The fourth upper flap 380 may have the first indentation 660 extending inwardly from an edge 770 of the fourth upper flap 380. Similarly, the fourth upper flap 380 may have the second indentation 670 positioned opposite to the first indentation 660. The cutout 80 may extend toward the fourth upper horizontal line 650 from the center 790 of the fourth upper flap 380.

Individual cutouts 80 from each of the upper flaps 350, 360, 370 and 380 may form the hole 740 as shown in FIG. 1 when the respective upper flaps are folded to construct the dispenser 20 as a box. For instance, in an embodiment, the second upper flap 360 and the fourth upper flap 380 may be folded at an angle perpendicular to their respective upper horizontal lines and inward toward each other. The upper flaps 350 and 370 may be folded inward toward each other on top of the upper flaps 360 and 380 to complete construction of the dispenser 20 as a box. While being pulled through the hole 740, the crumpled paper 30 may be severed to a desired length by contacting the crumpled paper 30 against an edge of either the first slit 230 or the second slit 240.

As shown by FIGS. 2A, 23 and 2C, the side panels 310, 320, 330 and 340 may each have a width 480. The width 480 of the side panels 310, 320, 330 and 340 may be defined as the distance from the first vertical line 540, 550, 560 and 570 associated with the panel 310, 320, 330 or 340 to the subsequent vertical line 540, 550, 560 and 570 associated with the panel 310, 320, 330 or 340. Similarly, the side panels 310, 320, 330 and 340 may have a length defined as the distance from the lower horizontal lines 580, 590, 600 and 610 to their respective upper horizontal lines 620, 630, 640 and 650. As shown, each of the side panels 310, 320, 330 and 340 may have a height 490. Next, each of the lower flaps 70, 270, 280 and 290 may have a width equal to the width of their respective associated side panel and may have a length defined as the distance from the edge of the lower flaps 70, 270, 280 and 290 to the associated lower horizontal lines 580, 590, 600 and 610. For instance, as shown in FIG. 2B, the lower flap 70 may have a length 520. Similarly, each of the upper flaps 350, 360, 370 and 380 may have a length 530 defined as the distance from an edge 770 of the upper flap 350, 360, 370 or 380 to the associated upper horizontal line 620, 630, 640 or 650. As shown by FIGS. 2B and 2C, the length 530 may remain constant for the upper flaps 350, 360, 370 and 380.

Figure 3A:
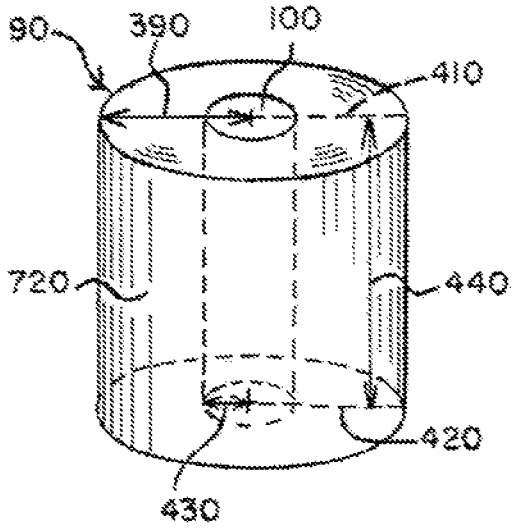
FIG. 3A illustrates a perspective view of an embodiment of a paper roll.
Figure 3B:
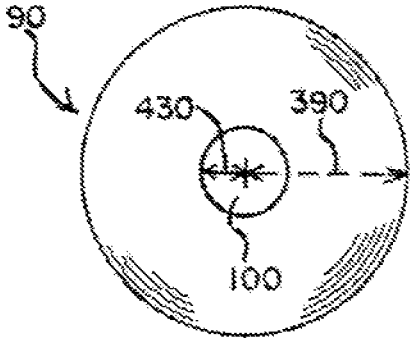
FIG. 3B illustrates a top view of an embodiment of a paper roll used in the present invention.

Referring to FIG. 3A, an illustration of the paper roll 90 having the airshaft 100 is shown. The airshaft 100 may be formed by a manufacturing technique with paper, such as the paper 720, for example, that may be first wound around an air core or a solid cylindrical core. The solid cylindrical core or the air core receives a desired quantity of paper wound around the core to create the paper roll 90 for example, with a hollow core, or the airshaft 100 as shown in FIG. 3A. Thus, a user may grasp the paper 720 initiating from the airshaft 100 of the paper roll 90 and pull the paper 720 from the airshaft 100 as desired. Further, the paper roll 90 may have a height 440 defined as the distance from an upper surface 410 and a lower surface 420. Also, the paper roll 90 may have the radius 390. The airshaft 100 around which the paper roll 90 is wound may have a radius 430. FIG. 3B shows a top view of the paper roll 90 with the airshaft 100. The paper roll 90 has the radius 390 while the airshaft 100 has a radius 430.

Figure 4:
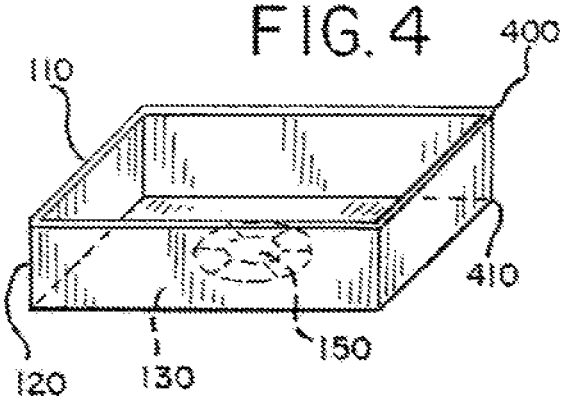
FIG. 4 illustrates a perspective view of an embodiment of a section having a crumpler of the present invention.

Referring to FIG. 4, the shelf section 110 is shown having a sidewall 120. The sidewall 120 may have a height defined by a top edge 410 and a bottom edge 420. Further, the sidewall 120 may be placed in the interior of the box 20 above and/or against the paper roll 90. At a center 800 of the shelf section 110 is the orifice 150 surrounded by the crumpler 130.

Figure 5:
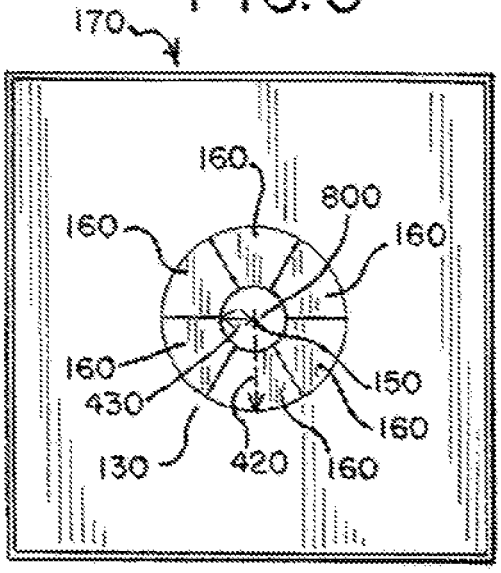
FIG. 5 illustrates a top view of an embodiment of a section having a crumpler of the present invention.

FIG. 5 illustrates an embodiment of the invention wherein the base section 170 of the shelf section 110 has the orifice 150 at the center of the base section 170 and/or surrounded by the crumpler 130. The crumpler 130, in the embodiment shown, has the protrusions 160. The protrusions 160 may have straight edges and/or serrated edges to enhance and/or assist in the crumpling of the paper 720 as the paper 720 is pulled through the crumpler 130.

Referring to FIG. 6, the crumpler 130 is shown wherein the protrusions 160 may move upwards in the vertical direction in response to a force applied to the protrusions 160 by the paper 720 as the paper 720 is pulled through the crumpler 130. Further, the protrusions 160 may resistively enlarge the orifice region 140 to allow the paper 720 to extend through the orifice region 140 located at/or and around the orifice 150. The protrusions 160 may contact the paper 720 as the paper 720 is pulled through the crumpler 130 to crumple the paper 720 to form the crumpled paper 30. The protrusions 160 may respond to the rate at which the paper 720 is pulled to accommodate additional paper when necessary. For example, pulling the paper 720 at a rapid and/or forceful manner may result in the protrusions 160 being lifted higher to thus allow additional paper 720 to flow through the crumpler 130. Conversely, pulling the paper 720 slowly and/or weakly may result in the protrusions 160 remaining relatively flush to the base section 170. The crumpling performance of the crumpler 130 may or may not be affected by the rate at which the paper 720 is drawn through the crumpler 130.

Although exemplary systems and methods are described in language specific to structural features and/or methodological acts, the subject matter defined in the appended claims is not necessarily limited to the specific features or acts described. Rather, the specific features and acts are disclosed as exemplary forms of implementing the claimed systems, methods and structures.

What is claimed is:

1. A paper crumpler comprising:

a dispenser having a bottom, a top spaced upward from the bottom, a side wall extending between the bottom and the top, and a cavity defined within the dispenser by the bottom, the top, and the side wall;

a hole formed in the top of the dispenser;

a shelf positioned within the cavity and spaced a distance below the top of the dispenser, the shelf dividing the cavity into a first section and a second section, the first section between the bottom and the shelf and the second section between the shelf and the top;

uncrumpled paper stored in the first section of the cavity; and an orifice formed in the shelf, wherein the orifice has protrusions that extend radially inward toward one another and that are configured to contact the uncrumpled paper when the uncrumpled paper is passed through the orifice from the first section to the second section to thereby form crumpled paper above the shelf.

2. The paper crumpler of claim 1, wherein the dispenser is a box formed of folded cardboard material.

3. The paper crumpler of claim 1, wherein the side wall includes four side panels arranged around the cavity in a rectangular tube shape.

4. The paper crumpler of claim 3, wherein the side panels are interconnected to one another and configured to unfold to the rectangular tube shape.

5. The paper crumpler of claim 3, wherein each of the side panels has an upper flap interconnected to an upper edge of the respective side panel.

6. The paper crumpler of claim 5, wherein one or more of the upper flaps has a cutout, wherein the upper flaps are configured to fold inward to define the top of the dispenser, and wherein the cutouts of the upper flaps align to form the hole in the top of the dispenser.

7. The paper crumpler of claim 6, wherein each of the cutouts is formed on an edge of a respective one of the upper flaps.

8. The paper crumpler of claim 3, wherein each of the side panels has a lower flap interconnected to a lower edge of the respective side panel, wherein the lower flaps are configured to fold inward to define the bottom of the dispenser.

9. The paper crumpler of claim 1, wherein the hole is substantially circular.

10. The paper crumpler of claim 1, wherein the shelf is parallel to the bottom and the top of the dispenser.

11. The paper crumpler of claim 1, wherein the hole and the orifice are vertically aligned with one another.

12. The paper crumpler of claim 1, wherein the uncrumpled paper is stored in a roll form within the cavity, the roll form having an axis that is oriented vertically within the cavity.

13. A paper crumpler comprising:

a dispenser having a bottom, a top spaced upward from the bottom, a side wall extending between the bottom and the top, and a cavity defined within the dispenser by the bottom, the top, and the side wall;

a hole formed in the top of the dispenser;

a shelf positioned within the cavity and spaced a distance below the top of the dispenser, the shelf dividing the cavity into a first section and a second section, the first section between the bottom and the shelf and the second section between the shelf and the top;

uncrumpled paper stored in the first section of the cavity; and an orifice formed in the shelf, wherein the orifice has protrusions that extend radially inward toward one another and that are configured to contact the uncrumpled paper when the uncrumpled paper is passed through the orifice from the first section to the second section to thereby form crumpled paper above the shelf, wherein the top includes at least one slit formed extending from the hole and configured to assist in severing a length of the crumpled paper.

14. A paper crumpler comprising:

a dispenser having a bottom, a top spaced upward from the bottom, a side wall extending between the bottom and the top, and a cavity defined within the dispenser by the bottom, the top, and the side wall;

a hole formed in the top of the dispenser;

a shelf positioned within the cavity below the top of the dispenser;

uncrumpled paper stored in a roll form within the cavity beneath the shelf, the roll form having an axis that is oriented vertically within the cavity; and an orifice formed in the shelf, wherein the orifice has protrusions that extend radially inward toward one another and that are configured to contact the uncrumpled paper when the uncrumpled paper is passed through the orifice from the cavity to thereby form crumpled paper above the shelf, and wherein the crumpled paper can be dispensed from the dispenser through the hole.

15. The paper crumpler of claim 14, wherein the shelf is formed as a separate piece positioned within the cavity.

16. The paper crumpler of claim 14, wherein the hole in the top is non-circular.

17. The paper crumpler of claim 14, wherein the dispenser is a cardboard box formed from a foldable cardboard material blank.

18. The paper crumpler of claim 17, wherein the side wall includes four interconnected side panels folded and arranged around the cavity in a rectangular tube shape.

19. The paper crumpler of claim 18, further comprising:

an upper flap interconnected to an upper edge of each of the side panels;

a cutout formed on an edge of each of the upper flaps, wherein the upper flaps are configured to fold inward to define the top of the dispenser, and wherein the cutouts of the upper flaps together form the hole in the top of the dispenser; and a lower flap interconnected to a lower edge of each of the side panels, wherein the lower flaps are configured to fold inward to define the bottom of the dispenser.

20. The paper crumpler of claim 14, wherein the top includes at least one slit formed extending from the hole and configured to assist in severing a length of the crumpled paper.

* * * * *